US010982513B2

(12) United States Patent
Gupta et al.

(10) Patent No.: US 10,982,513 B2
(45) Date of Patent: Apr. 20, 2021

(54) INTEGRATED LOADING TUBE

(71) Applicant: Schlumberger Technology Corporation, Sugar Land, TX (US)

(72) Inventors: Ashutosh Gupta, Pune (IN); Stephen D'Mello, Pune (IN); Andrew Prisbell, Rosharon, TX (US); Hari Prakash Kalakonda, Pune (IN); Rucha Deshmukh, Pune (IN)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/271,004

(22) Filed: Feb. 8, 2019

(65) Prior Publication Data

US 2020/0256167 A1 Aug. 13, 2020

(51) Int. Cl.

| | |
|---|---|
| ***E21B 43/117*** | (2006.01) |
| ***E21B 43/119*** | (2006.01) |
| ***F42D 1/22*** | (2006.01) |

(52) U.S. Cl.

CPC ..... *E21B 43/119* (2013.01); *E21B 43/117* (2013.01); *F42D 1/22* (2013.01)

(58) Field of Classification Search

CPC ..... E21B 43/11; E21B 43/116; E21B 43/117; E21B 43/119; E21B 43/1185

USPC ..... 89/1.15, 1.151; 175/2, 4.51, 4.57

See application file for complete search history.

(56) References Cited

U.S. PATENT DOCUMENTS

| | | | | |
|---|---|---|---|---|
| 4,191,265 | A | 3/1980 | Bosse-Platiere | |
| 4,519,313 | A * | 5/1985 | Leidel | F42D 1/04 102/310 |
| 4,850,438 | A | 7/1989 | Regalbuto | |
| 9,115,572 | B1 | 8/2015 | Hardesty et al. | |
| 9,494,021 | B2 | 11/2016 | Parks et al. | |
| 9,581,422 | B2 | 2/2017 | Preiss et al. | |
| 9,605,937 | B2 | 3/2017 | Eitschberger et al. | |
| 9,702,680 | B2 * | 7/2017 | Parks | F42D 1/04 |
| 9,903,185 | B2 | 2/2018 | Ursi et al. | |
| 10,188,990 | B2 * | 1/2019 | Burmeister | B01D 65/00 |
| 10,458,213 | B1 * | 10/2019 | Eitschberger | E21B 43/1185 |
| 2015/0330192 | A1 * | 11/2015 | Rogman | E21B 43/11855 166/297 |
| 2016/0168961 | A1 * | 6/2016 | Parks | E21B 43/117 89/1.15 |
| 2016/0356132 | A1 * | 12/2016 | Burmeister | E21B 43/119 |
| 2017/0052011 | A1 * | 2/2017 | Parks | F42D 1/02 |
| 2017/0275976 | A1 * | 9/2017 | Collins | E21B 43/119 |

(Continued)

FOREIGN PATENT DOCUMENTS

| | | | | |
|---|---|---|---|---|
| CA | 3044516 A1 * | 7/2018 | | E21B 43/117 |
| EP | 0132330 A2 | 1/1985 | | |

(Continued)

OTHER PUBLICATIONS

H-2 Perforating System, Titan division, 2019 (1 page).

(Continued)

*Primary Examiner* — Jonathan C Weber

(74) *Attorney, Agent, or Firm* — Cameron R. Sneddon

(57) ABSTRACT

The present disclosure provides a loading tube to be used in a perforating gun. The loading tube is capable of securely engaging with shaped charges while maintaining the structural integrity and being made by injection molding.

5 Claims, 8 Drawing Sheets

(56) References Cited

U.S. PATENT DOCUMENTS

| | | | | |
|---|---|---|---|---|
| 2018/0306010 | A1* | 10/2018 | Von Kaenel | E21B 43/117 |
| 2019/0040722 | A1 | 2/2019 | Yang et al. | |
| 2019/0186241 | A1 | 6/2019 | Yang et al. | |
| 2019/0353013 | A1* | 11/2019 | Sokolove | E21B 43/1185 |
| 2020/0018139 | A1 | 1/2020 | Eitschberger et al. | |
| 2020/0024934 | A1 | 1/2020 | Eitschberger et al. | |
| 2020/0024935 | A1 | 1/2020 | Eitschberger et al. | |

FOREIGN PATENT DOCUMENTS

| | | | |
|---|---|---|---|
| RU | 2561828 | C2 | 9/2015 |
| WO | 2001096807 | | 12/2001 |
| WO | 2012135101 | A2 | 10/2012 |

OTHER PUBLICATIONS

Titan H2 Perforating Gun System, (2019) 2 pages, Link: https://www.oilfieldtechnology.com/product-news/07022019/hunting-introduces-h-2-perforating-system/.

International Search Report and Written Opinion issued in the PCT Application PCT/US2020/032879, dated Aug. 28, 2020 (10 pages).

* cited by examiner

INTEGRATED LOADING TUBE

FIELD OF INVENTION

The disclosure relates to the field of hydrocarbon well perforation. More specifically, apparatus and methods of loading shaped charge within perforating guns are disclosed.

BACKGROUND

When a hydrocarbon well is drilled, a casing may be placed in the well to line and seal the wellbore. Cement is then pumped down the well under pressure and forced up the outside of the casing until the well column is also sealed. This casing process: (a) ensures that the well is isolated, (b) prevents uncontrolled migration of subsurface fluids between different well zones, and (c) provides a conduit for installing production tubing in the well. However, to connect the inside of the casing and wellbore with the inside of the formation to allow for hydrocarbon flow from the formation to the inside of the casing, holes are formed through the casing and into the wellbore. This practice is commonly referred to as perforating of the casing and formation. Open-hole wells are also possible, i.e., where a casing is not used and jetting, fracturing or perforation is directly applied to the formation.

To perform a perforation operation, a loading tube carrying a plurality of shaped charges is inserted into a hollow gun carrier. The assembled gun body containing the loading tube with the plurality of shaped charges mounted therein is lowered into the wellbore and positioned opposite the subsurface formation to be perforated. Initiation signals are then passed from a surface location through a wireline to one or more blasting caps located in the gun body, thereby causing detonation of the blasting caps. The exploding blasting caps in turn transfer a detonating wave to a detonator cord which further causes the shaped charges to detonate. The detonated shaped charges form an energetic stream of high-pressure gases and high velocity particles, which perforates the well casing and the adjacent formation to form perforation tunnels. The hydrocarbons and/or other fluids trapped in the formation flow into the tunnels, into the casing through the orifices cut in the casing, and up the casing to the surface for recovery.

Prior to perforating, the target wells are studied to determine the most advantageous phase angles and spacing of the perforations. The desired orientation may be selected based on the possibility of sand production, based on the heavy overburden pressure and/or shear stress existing, or based on the location of control lines and/or other downhole equipment and tools. The loading tubes are then manufactured to hold the shaped charges at the predetermined phase angles and spacing.

Conventional loading tubes are formed of steel tubes in which the shaped charges are secured. metal, A pattern of cutouts is machined into the loading tube for holding the shaped charges in the desired orientation. Commonly, the loading tube uses plastic jackets to hold the shaped charges to the cut metal loading tube, because of the relatively good shock protection. However, the plastic jackets add manufacturing cost to the perforating gun. Alternatively, the loading tube has metal tabs cut out on the loading tube to facilitate the mounting of the shaped charges.

Machining the steel loading tubes to mount the shaped charges in the desired orientations adds to the overall manufacturing cost of the perforating guns. This particularly true for orientations of increased complexity.

What is needed is an improved, method and apparatus for manufacturing loading tubes more efficiently and at reduced cost.

SUMMARY

This summary is provided to introduce a selection of concepts that are further described below in the detailed description. However, many modifications are possible without materially departing from the teachings of this disclosure. Accordingly, such modifications are intended to be included within the scope of this disclosure as defined in the claims. This summary is not intended to identify key or essential features of the claimed subject matter, nor is it intended to be used as an aid in limiting the scope of the claimed subject matter.

An embodiment of the present disclosure provides a loading tube to be used in a perforating gun, comprising: a hollow tube to hold a detonating cord; and a plurality of holding structures affixed to the hollow tube. In this embodiment, the plurality of holding structures is spaced at a predetermined distance and phase angle from the next of the plurality of holding structures, and wherein each of the holding structures is adapted to securely engage a shaped charge.

Another embodiment of the present disclosure provides a loading tube to be used in a perforating gun, comprising: a first section having an upper component and a lower component snap-fit together, the first section housing a booster for the perforating gun; at least one second section having an upper component and a lower component snap-fit together to form a plurality of cavities to hold shaped charges; and a third section snap-fit together.

Yet another embodiment of the present disclosure provides a perforating gun, comprising: a hollow gun carrier; and a loading tube for carrying shaped charges, the loading tube mounted within the hollow gun carrier; wherein the loading tube is made from plastic, high density polystyrene, or high density polyethylene.

BRIEF DESCRIPTION OF THE DRAWINGS

Certain embodiments of the disclosure will hereafter be described with reference to the accompanying drawings, wherein like reference numerals denote like elements. It is emphasized that, in accordance with standard practice in the industry, various features are not drawn to scale. In fact, the dimensions of various features may be arbitrarily increased or reduced for clarity of discussion. It should be understood, however, that the accompanying figures illustrate the various implementations described herein and are not meant to limit the scope of various technologies described herein, and.

DETAILED DESCRIPTION

Figure 1:
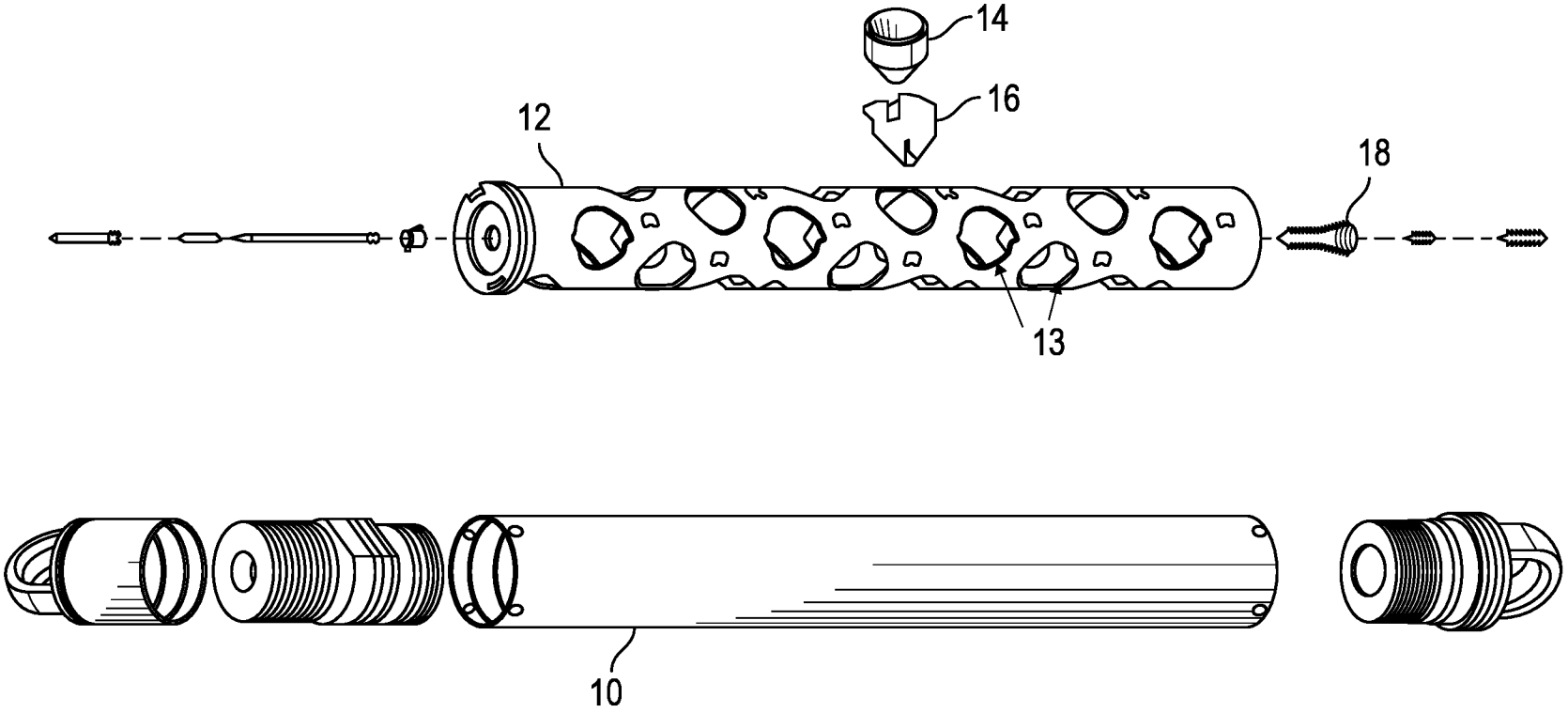
FIG. 1 (PRIOR ART)
FIG. 1 shows a cross section of a conventional hollow carrier perforating gun carrier.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for purposes of simplicity and clarity and does not in itself dictate a relationship between the various embodiments and/or configurations discussed. However, it will be understood by those of ordinary skill in the art that the system and/or methodology may be practiced without these details and that numerous variations or modifications from the described embodiments are possible. This description is not to be taken in a limiting sense, but rather made merely for purposes of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements.

In this disclosure, unless the context requires otherwise, throughout the specification and claims which follow, the word "comprise" and variations thereof, such as, "comprises" and "comprising" are to be construed in an open, inclusive sense, that is as "including, but not limited to."

In this disclosure, reference to "one embodiment" or "an embodiment" means that a particular feature or features, structures, or characteristics may be combined in any suitable manner in one or more implementations or one or more embodiments.

In this disclosure, the singular forms "a," "an," and "the" include plural referents unless the context clearly dictates otherwise. It should also be noted that the term "or" is generally employed in its broadest sense, that is, as meaning "and/or" unless the content clearly dictates otherwise.

The headings and Abstract of the disclosure provided herein are for convenience only and do not interpret the scope or meaning of the embodiments.

FIG. 1 shows a cross section of a conventional hollow carrier perforating gun carrier 10. The conventional perforating gun carrier 10 comprises a loading tube 12, a shaped charge 14 fitting into a jacket 16, and two ballistic transfer plastics 18 that connect to each end of the loading tube 12. The hollow carrier 10 is made of pressure-tight steel tubes, on which a plurality of cutouts 13 having the shape matching that of the jacket 16 are formed, in order to receive the jacket 16 and the shaped charge 14. In a typical loading tube, the jackets 16 are made of plastic to hold and mount the shaped charges 14 inside the cutouts 13, or in some cases metal tabs are cut out from the loading tube 12 to facilitate the mounting of the shaped charges 14. The ballistic transfer plastics 18 are essential for precise detonation of the shaped charges 14.

Figure 2:
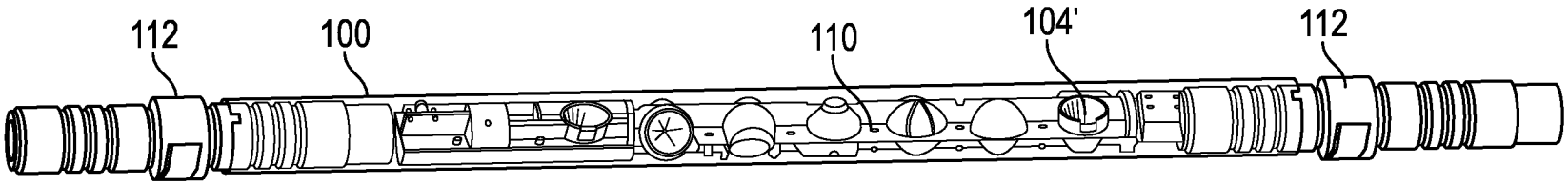
FIG. 2 is a schematic view of an embodiment of the perforating gun using the loading tube of the present disclosure.
Figure 3:
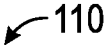
FIG. 3 is a schematic view of the embodiment the perforating gun illustrated in FIG. 2, with the hollow gun carrier removed.
Figure 3:
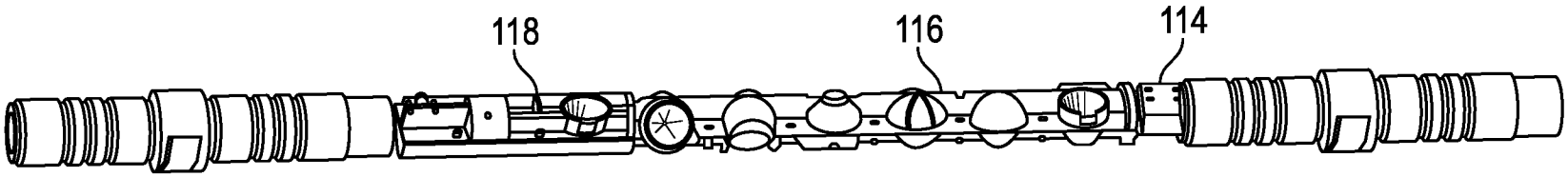

FIG. 2 is a schematic view of an embodiment of the perforating gun using a loading tube 110 of the present disclosure, and FIG. 3 is a similar view except the gun carrier 100 has been removed to better illustrate the loading tube 110. The following discussion is made with reference to both FIGS. 2 and 3.

The perforating gun of the present disclosure comprises a gun carrier 100 having a loading tube 110 housed therein. The gun carrier 100 is flanked by an adapter 112 on each end. A plurality of holding structures 104' are formed along the loading tube 110. It is to be noted that the location of these holding structures 104' are arranged according to a predetermined phase angle and spacing in order to achieve the intended perforation orientation. The loading tube 110 comprises a hollow core suitable for an integrated ballistic transfer for the capability of more precise detonation of the shaped charges mounted within the holding structures 104'.

In the illustrated embodiment of the present disclosure, the loading tube 110 is divided into three sections, namely a bottom section 114, an intermediate section 116, and a top section 118. In embodiments of the present disclosure, the length of the loading tube 110 can be adjusted by adding one or more intermediate sections 116. For example, if the length of each intermediate section 116 is one foot (1 ft), then it would require twenty (20) intermediate sections 116 to make a twenty foot (20 ft) loading tube 110.

Figure 4:
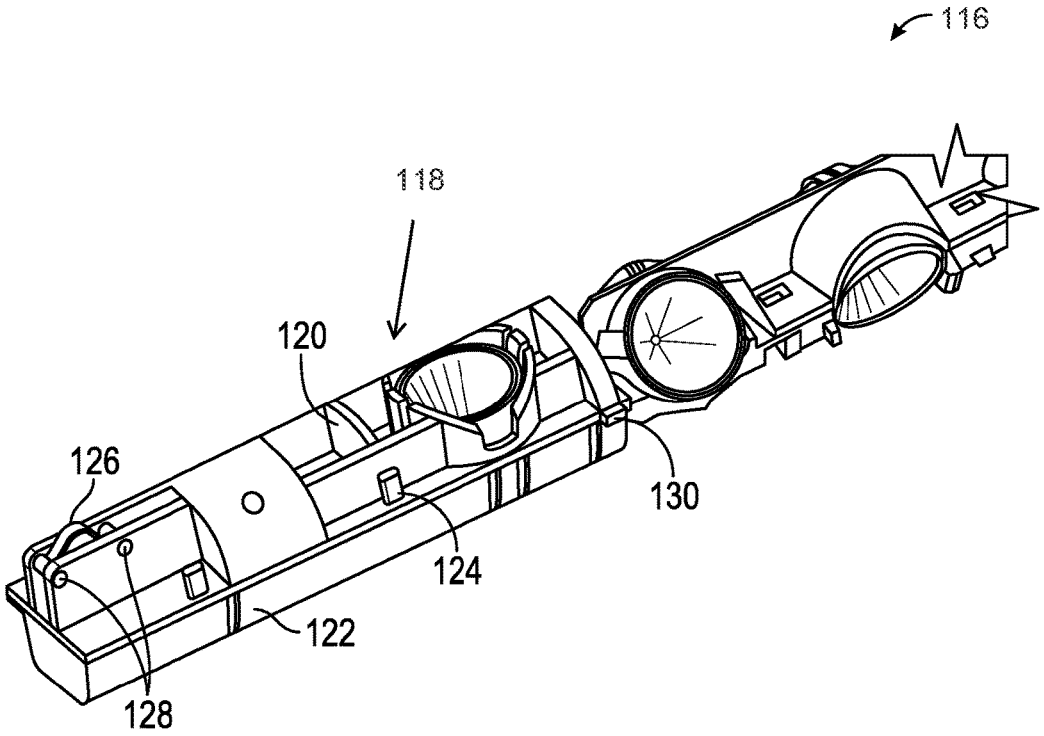
FIG. 4 shows a more detailed view of the top section of the loading tube, in accordance with embodiments of the present disclosure.

Referring now to FIG. 4, which shows the details of the top section 118 of the loading tube 110. A portion of the intermediate section 116 is shown in FIG. 4 to illustrate the relationship and connection between the top section 118 and the intermediate sections 116.

In order to facilitate manufacturing, the top section 118 is further divided into an upper component 120 and a lower component 122 that together form a complete tubular top section 118. In embodiments of the present disclosure, the upper component 120 and lower component 122 are made from plastic, high density polystyrene, or any other equivalent material that can be manufactured in many ways, with high quantity and low processing time, such as injection molding or 3D printing.

The upper component 120 may be securely coupled to the lower component 122 through, for example, snap-fit structures 124. It should be understood, however, that other types of secure coupling such as fasteners or clips may also be used and remain within the scope of the present disclosure.

Pins 128 are provided to maintain the orientation and alignment of the key spring 126 on the upper component 120. A key spring 126 on the top section 118 of the loading tube 110 will sit in the key way of the gun carrier 100, so as to align the loading tube 118 with the carrier 100.

Figure 5:
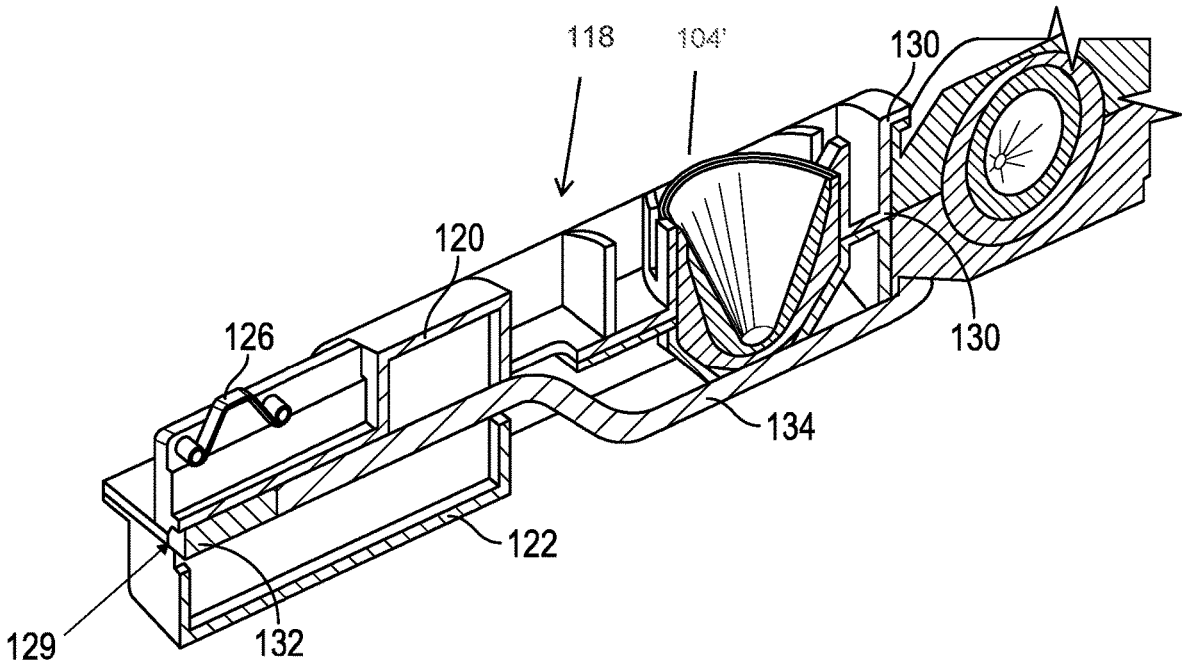
FIG. 5 is a cross-sectional view of the top section of the embodiment of the loading tube shown in FIG. 4.

FIG. 5 is a cross-sectional view of the embodiment of the top section 118 of the loading tube 110 shown in FIG. 4. As can be seen in FIG. 5, a booster 132 is connected to a detonation cord 134 within the hollow core formed between the upper component 120 and the lower component 122 of the loading tube 118. The ballistic transfer from one perforating gun to another will be transferred through the detonation cord 134, which is securely housed within the hollow core 129 of the top section 118. As illustrated, the top section 118 of the loading tube 110 is designed in such a way that the booster 132 is secured in place while maintaining the booster to booster gap, which is required for successful ballistic transfer.

Figure 6:
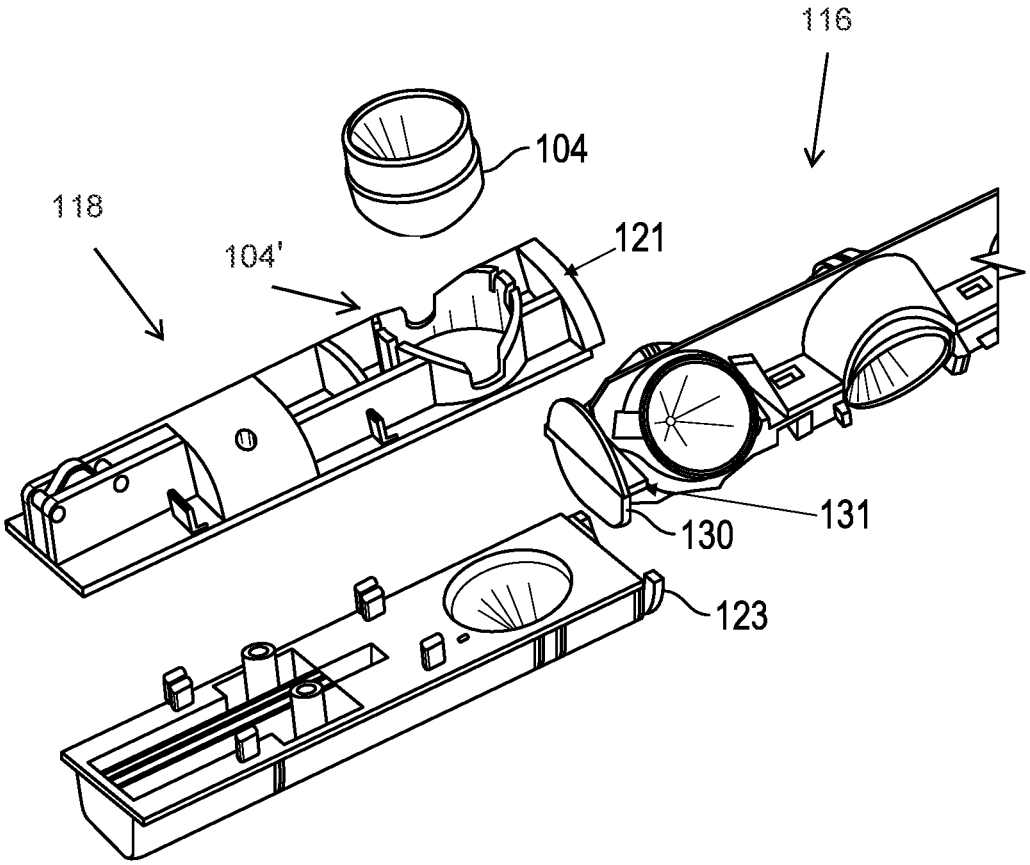
FIG. 6 is an exploded view of the components of the top section of the loading tube illustrated in FIG. 5.

FIG. 6 is an exploded view illustrating the way in which the components of the top section 118 of the loading tube 110 are connected. Additionally shown in FIG. 6 is a shaped charge 104 for mounting within the holding structure 104'.

Figure 7:
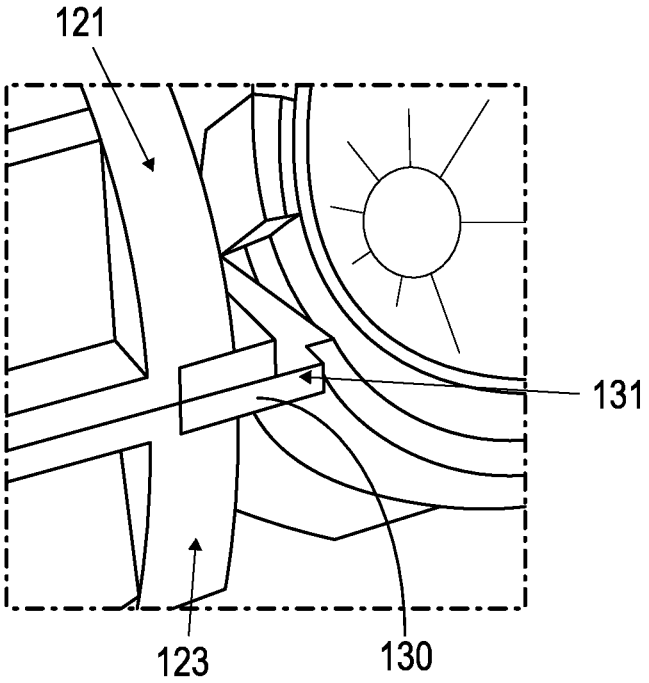
FIG. 7 is a detailed view of an embodiment of an anti-rotation connection, in accordance with the present disclosure.

An anti-rotation connection 130 (shown in detailed view in FIG. 7) is provided between the top section 118 and the intermediate section 116. For example, the upper and lower components 120, 122 of the top section 118 can each have a receiving structure 121, 123 that, when combined together, will tightly engage with a flange 131 of the intermediate section 116. The connection is designed such that the rotation between the top intermediate sections 118,116 can be prevented. This anti-rotation feature is important to maintain the phase angle of each of the holding structures 104' for the respective shaped charges 104. This is especially important when more than one intermediate section 116 is employed to extend the length of the loading tube 110.

Figure 8:
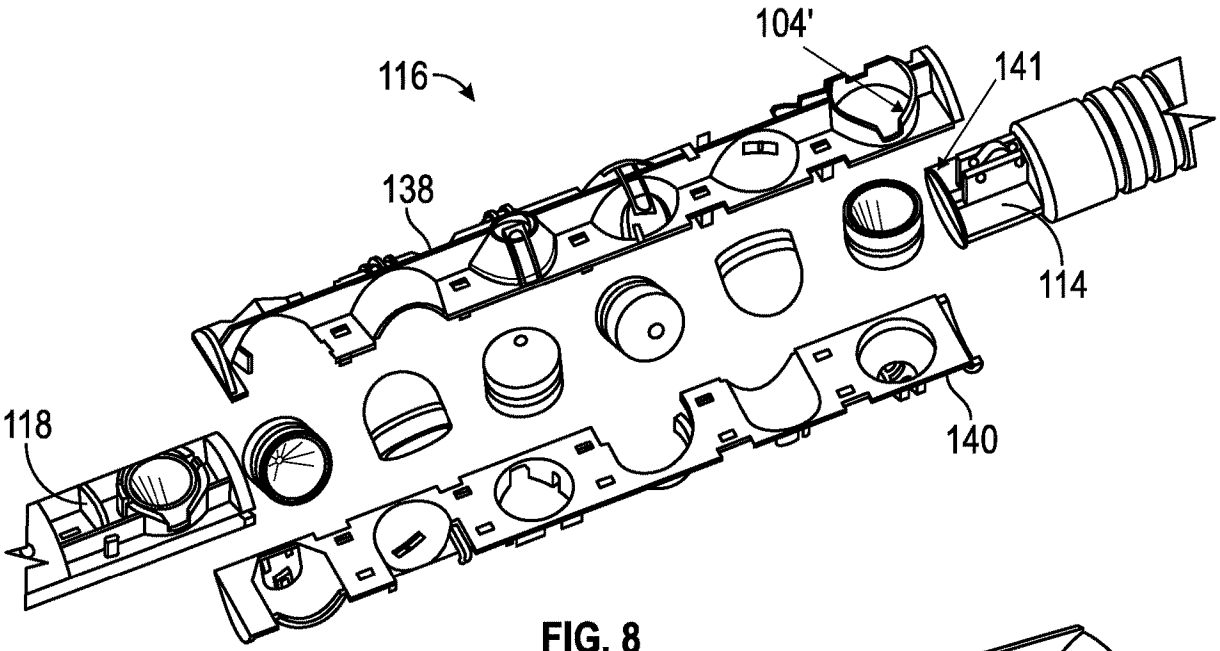
FIG. 8 is an exploded of an embodiment of the intermediate section of the loading tube of the present disclosure.
Figure 9:
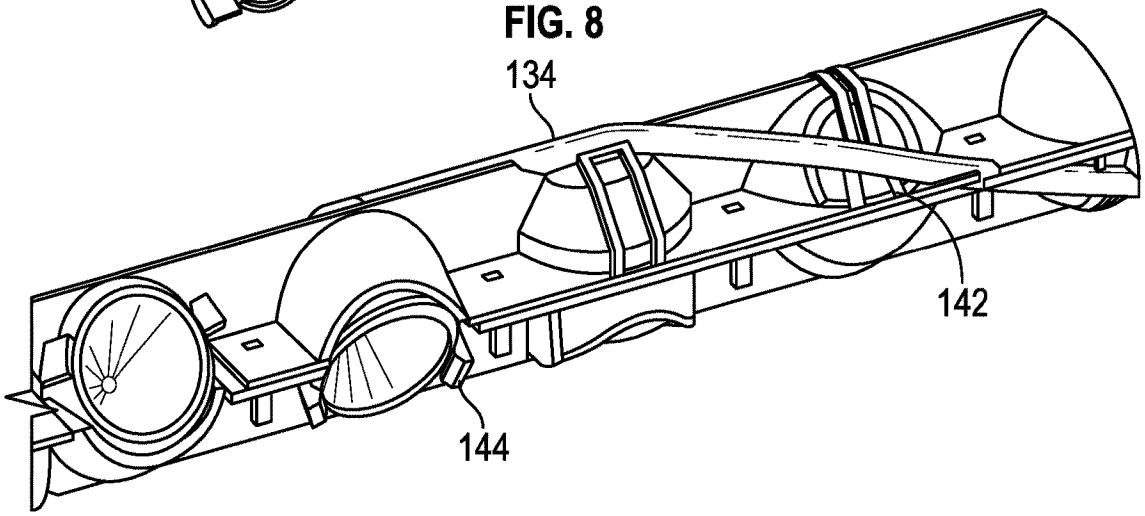
FIG. 9 is a partially enlarged view of and embodiment of the intermediate section of the loading tube of the present disclosure.

An embodiment of the intermediate section 116 of the present disclosure is shown in FIG. 8 and FIG. 9. FIG. 8 is an exploded view of the intermediate section 116, and FIG. 9 is a partially enlarged view of the intermediate section 116. As with the top section, in order to facilitate manufacturability, the intermediate section 116 is divided into an upper component 138 and a lower component 140. In embodiments of the present disclosure, the upper component 138 and lower component 140 are made from plastic, high density polystyrene, or any other equivalent material that can be manufactured in many ways, with high quantity and low processing time, such as injection molding or 3D printing.

In the embodiment shown, the upper component 138 and the lower component 140 can be securely joined together by known mechanical structures, such as snap fit, to form a tubular structure with a plurality of cavities that act as holding structures 104' for the shaped charges. The holding structures 104' secure the charges in place with one or more snap structures 144. Similar to the top section 118, these holding structures 104' are provided on the intermediate section 116 according to the predetermined phase angle and di stance.

As shown in FIG. 9, the intermediate section 116 has one or more guide features 142 provided to guide the detonation cord 134. The guide features 142 ensure that the detonation cord 134 remains in contact with each of the shaped charges carried on the loading tube 110.

An anti-rotation connection 141 between the intermediate section 116 and the bottom section 114, similar to that between the top and intermediate sections 118, 116, can also be provided to prevent any rotation.

Figure 10:
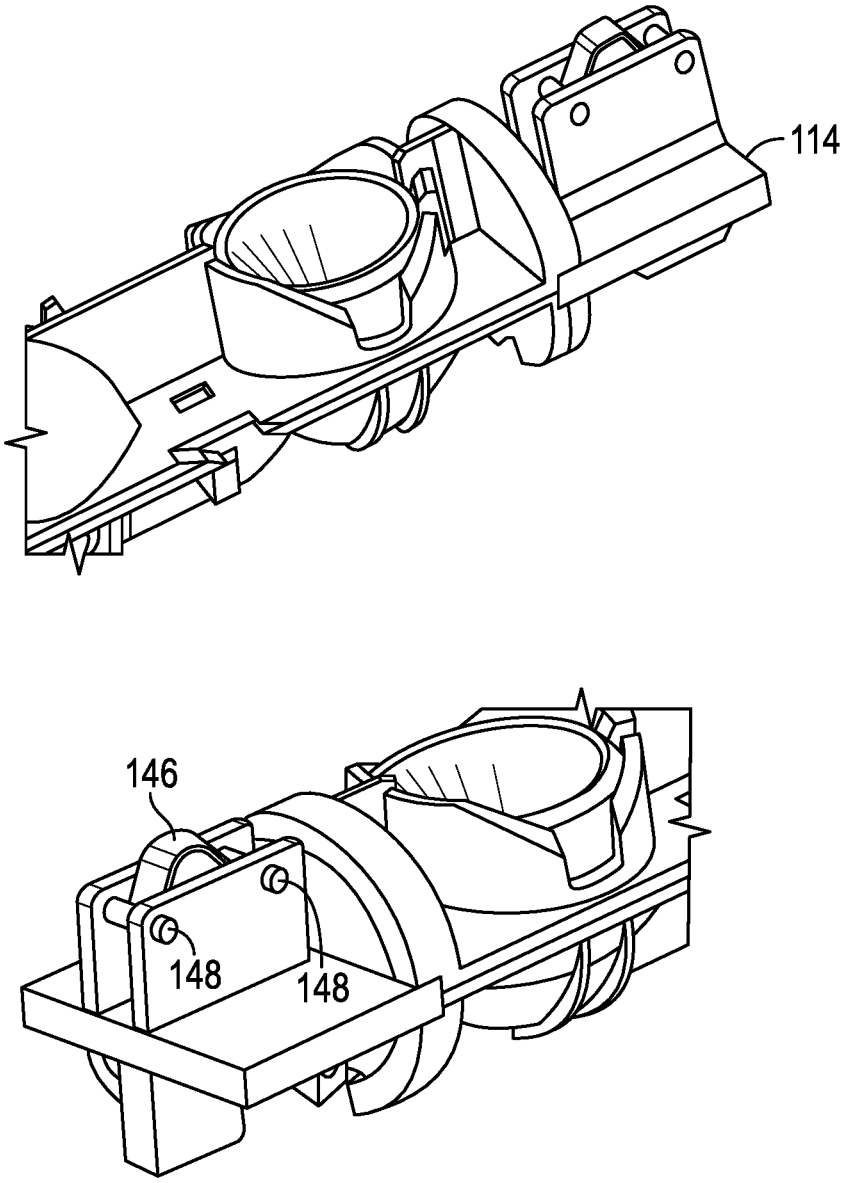
FIG. 10 is a partially enlarged view of the connection between the bottom section of the loading tube and a subsequent perforating gun, in accordance with the present disclosure.

FIG. 10 illustrates a partially enlarged view of the connection between the bottom section 114 and the next perforating gun (not shown). As can be seen in FIG. 10, a key spring 146 is provided in the key way of the carrier to align the loading tube 110 with the perforating gun carrier 100. Again, pins 148 are provided to maintain the position of the key spring 146. A similar anti-rotation mechanism can also be provided.

In the embodiments discussed above, the loading tube 110 and its various components are made from materials that can be molded such as plastic, high density polystyrene or equivalent material. The resulting loading tube 110 can be manufactured at low cost and the components are easily assembled. Additionally, the cavities or holding structures 104' are formed through assembly and have a similar profile to match the shape of the shaped charges 104. By combining the loading tube 110 and the shaped charge jackets, the manufacturing cost is further reduced. The integration of the ballistic transfer features in the top section 118 and the bottom section 114 of the loading tube 110 eliminates the need for separate parts to secure the booster in place for ballistic transfer.

Figure 11:
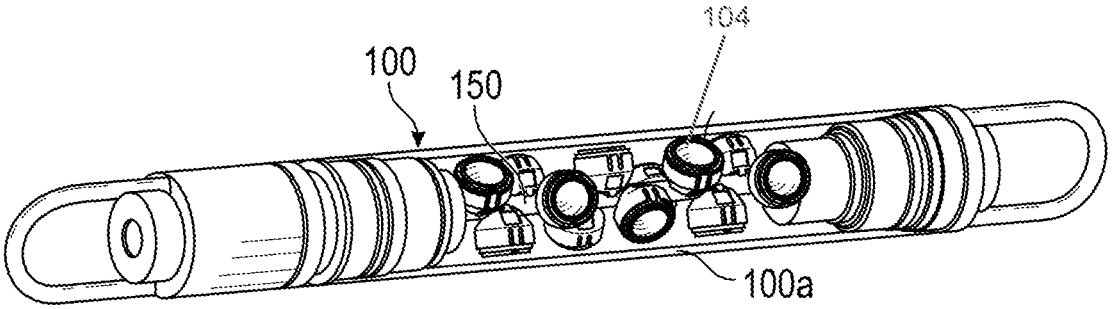
FIG. 11 shows another embodiment of the perforating gun carrier with a skeletal loading tube.

FIG. 11 shows another embodiment of the loading tube of the present disclosure. In this embodiment, the loading tube mounted within the hollow gun carrier 100 is a skeletal loading tube 150 having a plurality of shaped charges 104. In the embodiment shown, the wall 100*a* of the gun carrier 100 may have one or more scallops aligned with the shaped charges 104. But it is understood that gun carriers 100 without scallops may also be used with embodiments of the skeletal loading tube 150 of the present invention.

Figure 12:
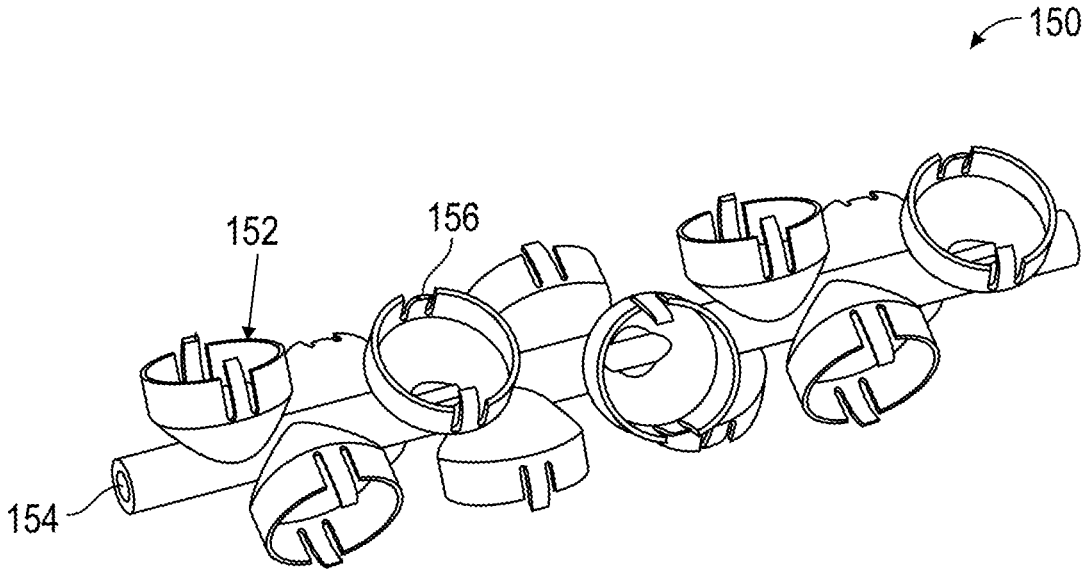
FIG. 12 shows an embodiment of the skeletal loading tube having a plurality of holding structures integrally formed with a hollow tube.

FIG. 12 shows a more detailed view of an embodiment of a skeletal loading tube 150 of the present disclosure having a plurality of holding structures 152 integrally formed with a hollow tube 154 that allows the detonating cord (not shown) to contact each of the shaped charges 104 to pass and transfer ballistic shock to them. The holding structures 152, or cavities, have profiles to match the shaped charges 104 to be mounted therein. The orientation of each holding structure 152 is predetermined according to the preferred phase angles of the shaped charges 104. Each of the holding structures 152 may have one or more locking tabs 156 such that once the shaped charge 104 is inserted, the locking tab 156 secures the shaped charge 104 to the skeletal loading tube 150 in the correct orientation.

Figure 13:
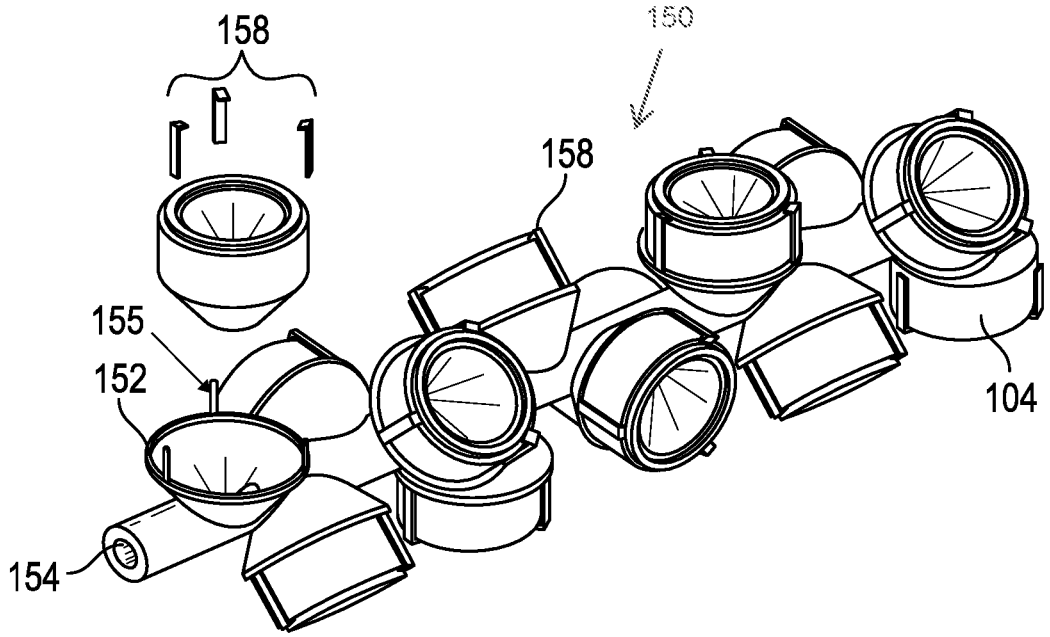
FIG. 13 shows another embodiment of the skeletal loading tube of this disclosure.

FIG. 13 shows another embodiment of the skeletal loading tube 150 of the present disclosure. As can be seen in FIG. 13, the skeletal loading tube 150 in this embodiment comprises the holding structures 152 integrally formed with the hollow tube 154 that allows the detonating cord to pass therethrough. This embodiment further comprises plastic clips 158.

In this embodiment, each holding structure 152 is sized and shaped to receive a shaped charge 104. Once in place, the protrusions 155 of the holding structures 152 engage, or are engaged by, the plastic clips 158 to lock the shaped charge 104 in place within the holding structure. In this embodiment, three clips 158 are shown. However, in other embodiments, depending on the size and shape of the shaped charge, any number of clips 158 may be used and remain within the purview of the present disclosure.

Figure 14:
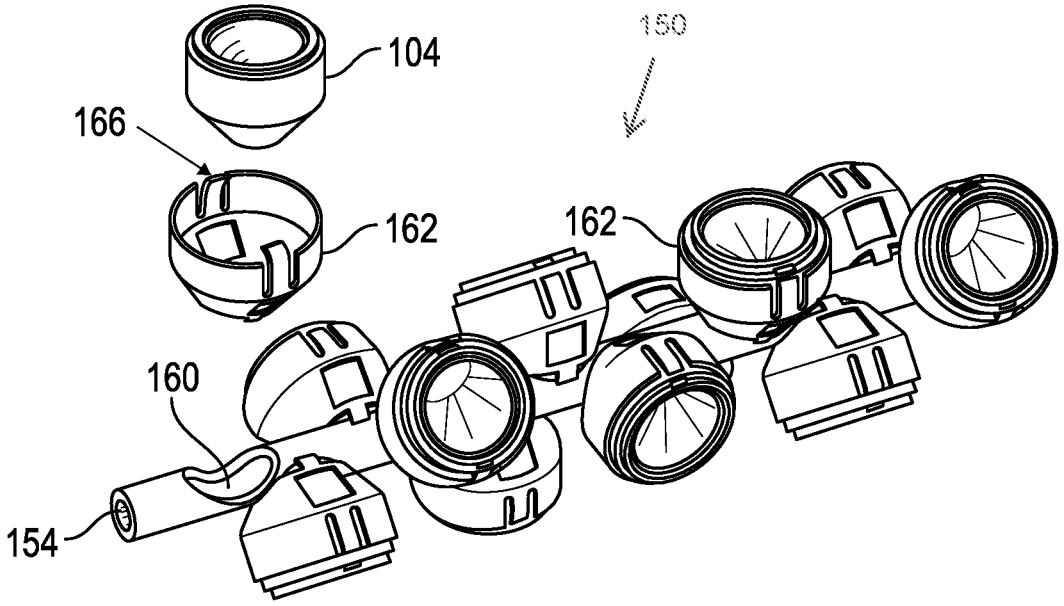
FIG. 14 shows another embodiment of the skeletal loading tube of this disclosure.

FIG. 14 shows another embodiment of the skeletal loading tube 150 of this disclosure. As seen in FIG. 14, the skeletal loading tube 150 consists of two parts: a plurality of jackets 162 that are mounted on a hollow tube 154. A snap mechanism is provided on the bottom of the jacket 162, such that when the jacket 162 is inserted into the cutouts 160 formed on the hollow tube 154, the jacket 162 can stay in place. Similar to previous embodiments, the cutouts 160 in the hollow tube 154 enable proper phasing of the shaped charges 104.

Each jacket 162 further comprising a securing mechanism (such as the tab 166) to secure the shaped charge 104 once the shaped charge 104 is inserted into the jacket 162. The detonating cord will pass through the hollow tube 154 to contact each of the shaped charges 104 in order to transfer the ballistic shock to each of the shaped charges 104.

In embodiments of the skeletal loading tube 150 of the present disclosure, the loading tube 150 may be formed by molding a material such as plastic, high density polystyrene or any other equivalent material. The skeletal loading tube 150 may be formed by methods such as injection molding or by 3D printing, for example. In other embodiments, casting can also be an option to manufacture the parts, depending on the materials used.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded. In the claims, means-plus-function clauses are intended to cover the structures described herein as performing the recited function and not only structural equivalents, but also equivalent structures. It is the express intention of the applicant not to invoke 35 U.S.C. § 112, paragraph 6 for any limitations of any of the claims herein, except for those in which the claim expressly uses the words "means for" together with an associated function.

The invention claimed is:

1. A loading tube to be used in a perforating gun, comprising:

a first tubular section divided along an axis of the first tubular section into an upper component and a lower component, such that the upper and lower component, when snap-fit together, form the first tubular section, the first tubular section housing a booster for the perforating gun;

at least one second tubular section divided along an axis of the second tubular section into an upper component and a lower component, such that the upper and lower component, when snap-fit together form the second tubular section and a plurality of cavities to hold shaped charges, the at least one second tubular section connected to the first tubular section when the first tubular section upper and lower components are snap-fit together; and a third section connected to the at least one second tubular section when the second tubular section upper and lower components are snap-fit together.

2. The loading tube of claim 1, wherein the first section, the at least one second section, and the third section are made from moldable materials.

3. The loading tube of claim 1, wherein the first section, the at least one second section, and the third section are made from plastic, high density polystyrene, or high density polyethylene.

4. The loading tube of claim 1, wherein the first section, the at least one second section, and the third section are made by injection molding.

5. The loading tube of claim 1, wherein the first section, the at least one second section, and the third section are made by 3D printing.

* * * * *